US009153894B2

(12) United States Patent
Gerwatowski

(10) Patent No.: US 9,153,894 B2
(45) Date of Patent: Oct. 6, 2015

(54) TERMINAL POSITION ASSURANCE WITH DUAL PRIMARY LOCK REINFORCEMENT AND INDEPENDENT SECONDARY LOCK

(71) Applicant: Yazaki North America, Inc., Canton, MI (US)

(72) Inventor: Justin T. Gerwatowski, Northville, MI (US)

(73) Assignee: Yazaki North America, Inc., Canton, MI (US)

( * ) Notice: Subject to any disclaimer, the term of this patent is extended or adjusted under 35 U.S.C. 154(b) by 77 days.

(21) Appl. No.: 14/076,352

(22) Filed: Nov. 11, 2013

(65) Prior Publication Data

US 2015/0133002 A1 May 14, 2015

(51) Int. Cl.

| | |
|---|---|
| ***H01R 3/00*** | (2006.01) |
| ***H01R 13/424*** | (2006.01) |
| ***H01R 13/422*** | (2006.01) |
| ***H01R 13/436*** | (2006.01) |

(52) U.S. Cl.

CPC ..... *H01R 13/424* (2013.01); *H01R 13/4223* (2013.01); *H01R 13/4362* (2013.01)

(58) Field of Classification Search

CPC .. H01R 13/40; H01R 13/422; H01R 13/4223; H01R 13/4226; H01R 13/424; H01R 13/426

USPC ..... 439/595, 352, 744, 750–752

See application file for complete search history.

(56) References Cited

U.S. PATENT DOCUMENTS

| | | | | |
|---|---|---|---|---|
| 5,167,534 | A | 12/1992 | Ohsumi | |
| 5,595,509 | A | 1/1997 | Fry et al. | |
| 5,782,657 | A | 7/1998 | Wolla et al. | |
| 6,322,391 | B1 | 11/2001 | Kodama | |
| 7,204,725 | B2 | 4/2007 | Yamashita | |
| 7,695,297 | B2 * | 4/2010 | Pittenger et al. | 439/157 |
| 7,828,607 | B2 * | 11/2010 | Kojima | 439/752 |

FOREIGN PATENT DOCUMENTS

EP 1641083 A2 3/2006

OTHER PUBLICATIONS

Partial European Search Report issued on Jun. 5, 2015 in European Application No. 14192415.9.

* cited by examiner

*Primary Examiner* — Khiem Nguyen

(74) *Attorney, Agent, or Firm* — Harness, Dickey & Pierce, P.L.C.

(57) ABSTRACT

The present teachings provide for a connector including a first body and an assurance body. The first body defines a first locking member, a cavity and a slot. The cavity accepts a terminal inserted therein to a first distance. The slot extends into the first body and intersects the cavity. The first locking member is configured to prevent withdrawal of the terminal when the terminal is inserted to the first distance. The assurance body is movable between a preset and a full set position within the slot, and includes a reinforcing member and a second locking member. The full set position, the reinforcing member limits movement of the first locking member to prevent the withdrawal of the terminal, and the second locking member extends into the cavity to prevent withdrawal of the terminal independent of the first locking member.

20 Claims, 4 Drawing Sheets

TERMINAL POSITION ASSURANCE WITH DUAL PRIMARY LOCK REINFORCEMENT AND INDEPENDENT SECONDARY LOCK

FIELD

The present disclosure relates to terminal position assurances with dual primary lock reinforcement and independent secondary lock.

BACKGROUND

This section provides background information related to the present disclosure which is not necessarily prior art.

Terminal position assurances are generally classified as one of two types—a primary lock reinforcement ("PLR"), or an independent secondary lock ("ISL"), both with their advantages and disadvantages. A PLR reinforces a primary locking mechanism, but should the primary locking mechanism fail, the PLR does not provide a redundant lock to keep the terminal in the housing. Thus a PLR does not increase terminal to connector retention. An ISL provides an additional securing function independent of the primary locking mechanism, but an ISL does not back up the primary locking mechanism and can have problems detecting partially seated terminals when the terminal is near its lockup position. Including a PLR and a separate ISL can increase the size, weight, complexity, and cost of the connector assembly.

SUMMARY

This section provides a general summary of the disclosure, and is not a comprehensive disclosure of its full scope or all of its features.

The present teachings provide for a connector including a first housing assembly. The first housing assembly includes a first body and an assurance body. The first body defines a first locking member, a cavity, and a slot. The cavity is configured to accept a terminal inserted therein from a first side of the first body to a first distance from the first side. The slot extends into the first body from a second side and intersects the cavity. The first locking member is coupled to the first body and extends into the cavity to prevent withdrawal of the terminal when the terminal is inserted to the first distance. The assurance body is slideably inserted into the slot and movable between a preset position and a full set position within the slot. The assurance body includes a reinforcing member and a second locking member. When the assurance body is in the full set position, the reinforcing member is configured to limit movement of the first locking member to prevent the withdrawal of the terminal from the cavity, and the second locking member extends into the cavity to limit movement of the terminal and prevent withdrawal of the terminal independent of the first locking member.

The present teachings further provide for a connector including a first housing assembly. The first housing assembly has a terminal, a first body, and an assurance body. The first body defines a resilient arm, a cavity, and a slot. The cavity is configured to accept the terminal inserted therein from a first side of the first body. The slot intersects the cavity from a second side of the first body substantially perpendicular to the first side. The resilient arm is moveable between a first position and a second position. The resilient arm is coupled to the first body at a first end and freely extending therefrom to a second end. The second end extends into the cavity when in the first position and prevents withdrawal of the terminal when the terminal is fully inserted in the cavity.

The resilient arm cooperates with the terminal to move the resilient arm to the second position when the terminal is incompletely inserted in the cavity. The assurance body is slideably inserted into the slot and movable between a preset position and a full set position. The assurance body includes a reinforcing member and a locking member. The reinforcing member is configured to prevent the resilient arm from moving to the second position when the assurance body is in the full set position. The locking member is configured to extend into the cavity and prevent withdrawal of the terminal independent of the resilient arm when the terminal is fully inserted in the cavity and the assurance body is in the full set position. The terminal prevents the assurance body from being moved to the full set position when the terminal is incompletely inserted in the cavity.

The present teachings also provide for a connector including a first housing assembly having a terminal, a first body, a resilient arm, and an assurance body. The first body defines a cavity and a slot. The cavity is configured to accept the terminal inserted therein in a first direction. The slot is substantially perpendicular to the cavity and intersects the cavity. The resilient arm is coupled to the first body at a first end and freely extends therefrom in the first direction to a second end. The resilient arm is moveable between first and second positions and includes a locking surface and a ramp surface extending into the cavity when in the first position. The locking surface is configured to prevent withdrawal of the terminal when the terminal is fully inserted in the cavity and the resilient arm is in the first position. The ramp surface is configured to slideably engage the terminal during insertion to move the resilient arm to the second position. The resilient arm is biased to return to the first position when the terminal is fully inserted therein. The assurance body is slideably inserted into the slot and movable into between a preset position and a full set position. The assurance body includes a reinforcing member and a locking member. The reinforcing member is configured to prevent the resilient arm from moving to the second position when the assurance body is in the full set position. The locking member is configured to extend into the cavity to prevent withdrawal of the terminal independent of the resilient arm when the terminal is fully inserted and the assurance body is in the full set position. The reinforcing member is configured to prevent the assurance body from being moved into the full set position when the resilient arm is in the second position. The terminal prevents the assurance body from being moved into the full set position when the terminal is incompletely inserted in the cavity by engaging the locking member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are directed toward a connector with a primary lock, a primary lock reinforcement ("PLR"), and an independent secondary lock ("ISL") to ensure terminals remain properly positioned within the connector. The primary lock and ISL generally act to prevent withdrawal of the terminal from the connector, while the PLR generally acts to reinforce the primary lock. The connector also allows a user to detect improperly positioned terminals, as will be discussed in further detail. The connector can mate with a mating connector to allow for the transfer of electrical current therebetween, such as for transferring power and/or information signals for example. While electrical terminals are described, it is also contemplated that the terminals and any cables connected thereto may be capable of transferring information in other ways, such as through fiber optic connections for example.

Figure 1:
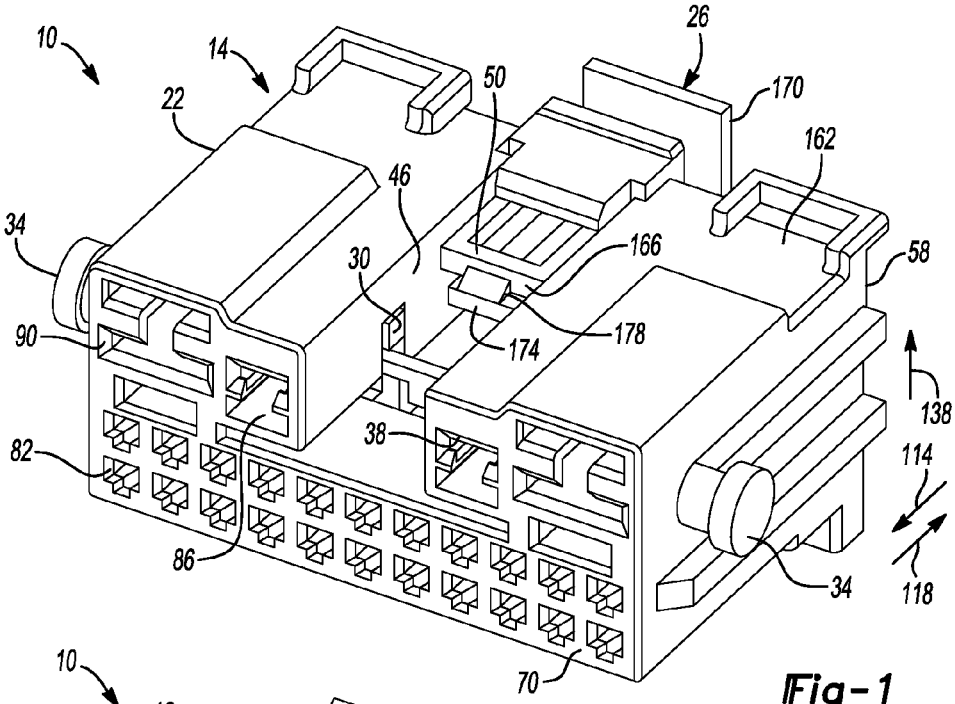
FIG. 1 is a perspective view of a first housing assembly of a connector in accordance with the present teachings.
Figure 2:
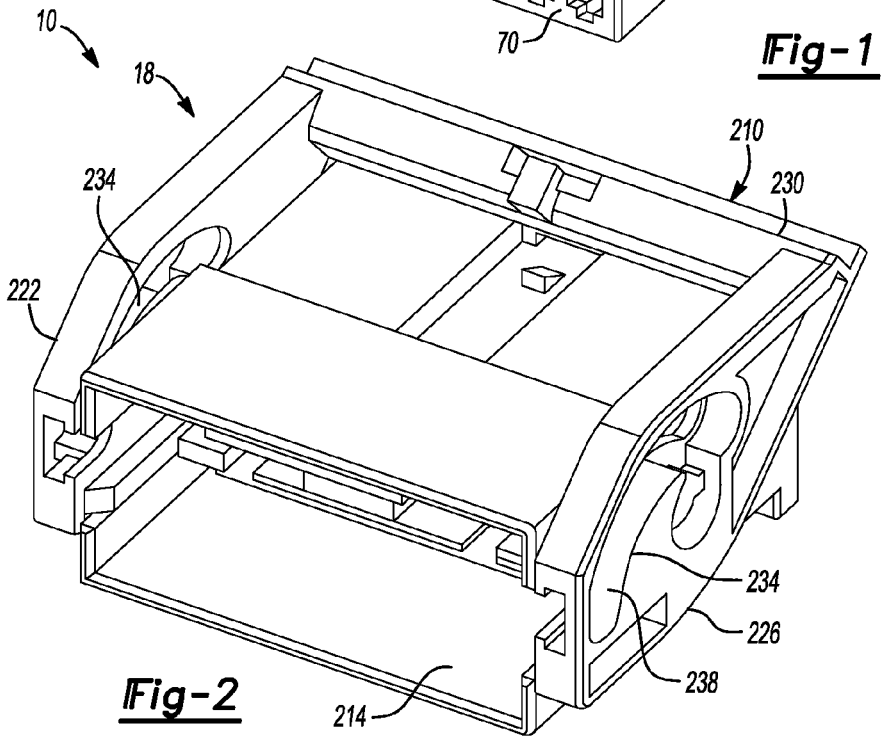
FIG. 2 is a perspective view of a second housing assembly of the connector.

With initial reference to FIGS. 1 and 2, a connector 10 can include a first housing assembly 14 and a second housing assembly 18. The first housing assembly 14 can be configured to mate with the second housing assembly 18 to allow for electrical connections to be made between wires (not shown) leading into the first and second housing assemblies 14, 18.

Figure 3:
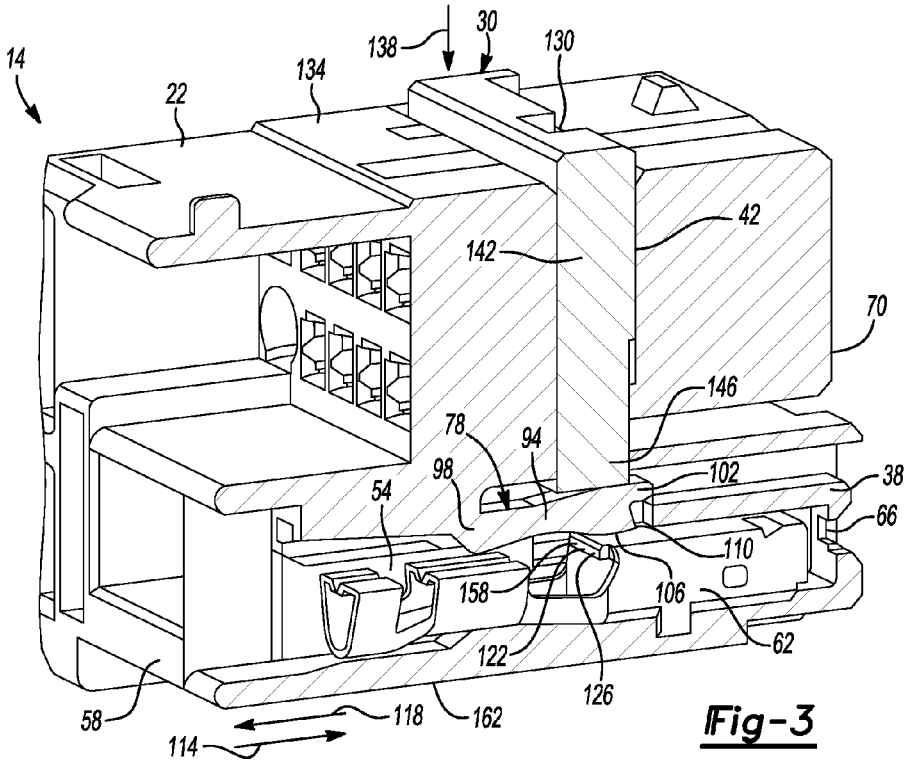
FIG. 3 is a cut-away perspective view of the first housing assembly of FIG. 1 in a preset position.

With reference to FIGS. 1 and 3, the first housing assembly 14 can include a first body 22, a connector assurance device 26, and a terminal position assurance ("TPA") 30. The first body 22 can define a pair of follower members 34, a plurality of bays 38, and a terminal position assurance slot ("TPA slot") 42. The first body 22 can also define a connector assurance channel 46, and a connector assurance retainer 50. Each follower member 34 can be coupled to an opposite side of the first body 22 and extend therefrom perpendicular to the sides.

Each of the bays 38 can define a cavity 54 open on a rear, or first side 58 of the first body 22 to receive a terminal 62 inserted from the rear side 58. Each bay 38 can define a mating aperture 66 on a front, or second side 70 of the first body 22 to allow the terminal 62 inserted within the bay 38 to mate with mating terminals 74 (shown in FIG. 7) housed in the second body 214, as will be described in further detail below. At least one of the bays 38 can also define a primary locking member 78. The terminals can be electrically coupled to wires (not shown), which extend from the rear side 58 of the first body 22 when the terminals 62 are inserted therein. The bays 38 can be arranged in a one or two dimensional array with adjacent bays 38 being side by side, and/or above or below each other. The bays 38 can also be of different sizes and shapes to accept different size or types of terminals 62. In the example provided, the connector 10 has bays 38 configured to receive 1.2 mm, 2.8 mm, and 6.3 mm terminals in a 22P×1.2+2P×2.8+2P×6.3 configuration. The first body 22 defines two rows of eleven 1.2 bays 82. The first body 22 defines two 2.8 bays 86 and two 6.3 bays 90 located above the two rows of 1.2 bays 38. The two 2.8 bays 86 are located between the two 6.3 bays 90. However, additional or fewer bays of different types and/or sizes and in different configurations can be used.

Figure 4:
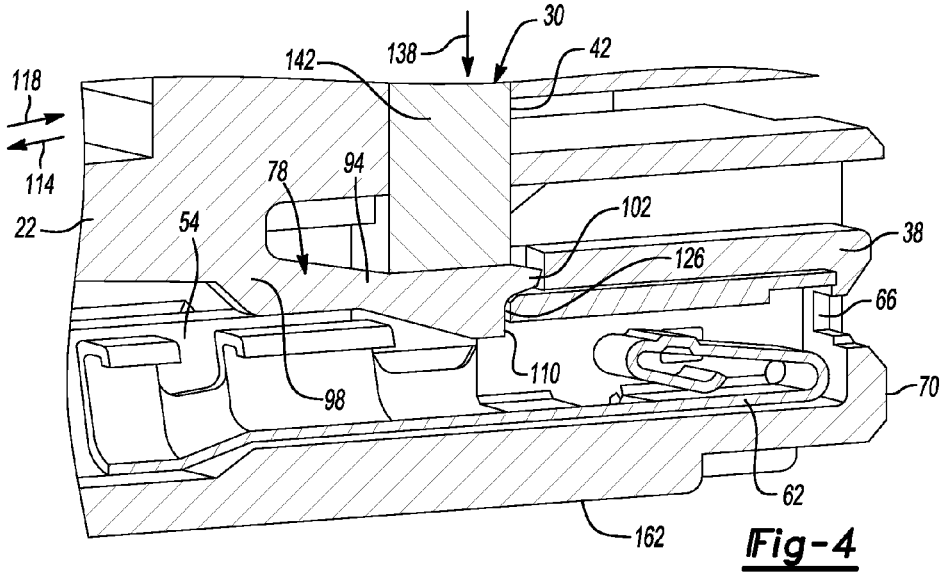
FIG. 4 is a detailed view of the first housing assembly of FIG. 3 in a full set position.

With reference to FIGS. 3 and 4, the primary locking member 78 can be configured to prevent withdrawal of the terminal 62 from the bay 38 to secure the terminal 62 within the cavity 54. While FIGS. 3 and 4 of the example illustrate the primary locking member 78 of the 2.8 bay 86 and the terminal 62 being a corresponding 2.8 terminal, it is understood in the following discussion that the primary locking member 78 can be similarly situated in any of the bays 38 to engage other types or sizes of terminals 62. The primary locking member 78 can include an arm 94 having a fixed end 98 coupled to the first body 22, and a free end 102 extending freely therefrom. The fixed end 98 can be coupled to the first body 22 proximal to the rear side 58 and the free end 102 can extend substantially toward the front side 70. It is also contemplated that the fixed end 98 could be coupled to the first body 22 proximal to a side other than the rear side 58, such as the front side 70 for example, and the free end 102 could extend therefrom to another side, such as the rear side 58 for example. The arm 94 can be moveable between a first position (shown in FIG. 4) and a second position (shown in FIG. 3). The arm 94 can be a resilient material such that it moves between the first and second positions by bending or flexing, and can bend or flex to pivot about the fixed end 98. The free end 102 can include a ramp 106 and a locking step 110. In the first position, the ramp 106 and locking step 110 can extend into the cavity 54.

During insertion of the terminal 62 into the cavity 54, the terminal 62 is inserted into the cavity 54 from the rear side 58 and moved in a first direction 114 toward the front side 70. The arm 94 can be biased toward the first position such that the arm 94 is initially extending into the cavity 54. The terminal 62 can be moved in the first direction 114 or a second direction 118 opposite the first direction 114, until the terminal reaches a first terminal position, a first distance from the rear side 58. At the first terminal position, the ramp 106 is configured to engage the terminal 62 such that the terminal 62 slides along the ramp 106 and forces the arm 94 to move toward the second position. When the arm 94 is in the second position, the terminal 62 is free to move in either the first direction 114 or the second direction 118. The terminal 62 can be moved in the first direction 114 to a second terminal position (shown in FIG. 4), a second distance from the rear side 58. In the second terminal position, a shoulder 122 of the terminal 62 allows the arm 94 to move from the second position to the first position due to the bias of the arm 94 toward the first position. When the arm 94 is in the first position, and the terminal 62 is in the second terminal position, the step 110 is configured to oppose and interfere with a first location 126 on the shoulder 122 to prevent the terminal 62 from moving in the second direction 118 and prevent the terminal 62 from being withdrawn from the cavity 54. The terminal 62 can be considered completely inserted when in the second terminal position.

The TPA slot 42 can define an aperture 130 open on a third side 134 of the first body 22, being substantially perpendicular to the front and rear sides 70, 58 and can extend into the first body 22 in a third direction 138, substantially perpendicular to the first direction 114. The TPA slot 42 can extend into the first body 22 and penetrate into at least one of the bays 38. The TPA slot 42 can penetrate through some or all of the bays 38. The TPA slot 42 can be configured to receive the TPA 30 inserted therein from the third side 134.

Figure 5:
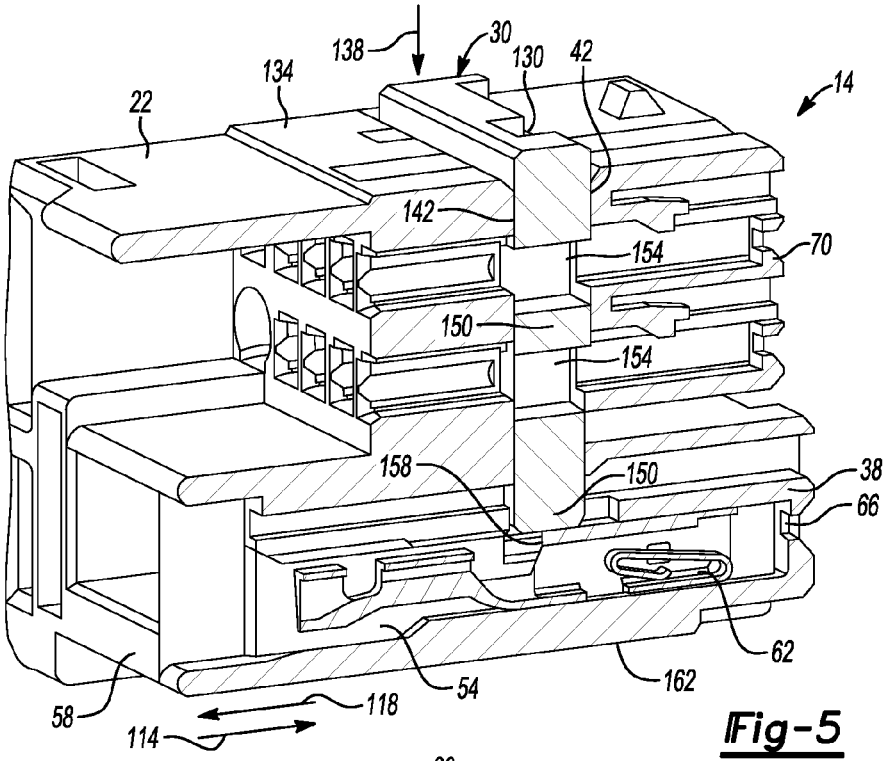
FIG. 5 is a cut-away perspective view of the first housing assembly of FIG. 3.
Figure 6:
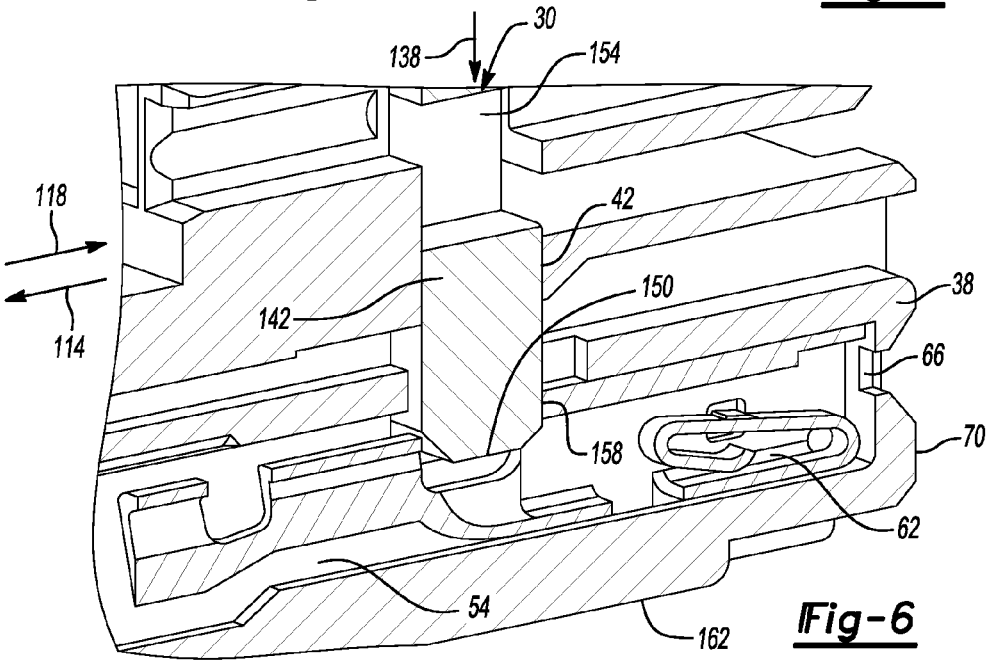
FIG. 6 is a detailed view of the first housing assembly of FIG. 5 in a full set position.

The TPA 30 can be slideably inserted into the TPA slot 42 and movable within the TPA slot 42 between a preset position (shown in FIGS. 3 and 5) and a full set position (shown in FIGS. 4 and 6). The TPA 30 can include a TPA body 142, at least one primary lock reinforcement member ("PLR member") 146, and at least one independent secondary lock member ("ISL member") 150. When the bays 38 are arranged above or below each other, the TPA body 142 can define a plurality of TPA aperture 154. When in the preset position, the plurality of TPA aperture 154 align with the plurality of cavities 54 to allow the plurality of terminals 62 to be inserted into the cavities and through the TPA body 142. Once the plurality of terminals 62 are fully inserted into the plurality of bays 38, and through the TPA aperture 154, the TPA 30 can be moved to the full set position. The PLR member 146 can be coupled to the TPA body 142 and can be integrally formed thereon. The PLR member 146 can be located on the TPA body 142 such that in the preset position, the primary locking member 78 is free to move between the first and second positions, while in the full set position, the PLR member 146 is configured prevent the primary locking member 78 from moving to the second position. In this way, the PLR member 146 reinforces the primary locking member 78 to prevent the step 110 from disengaging the shoulder 122 when the terminal 62 is in the second terminal position.

The PLR member 146 can also serve to detect an incompletely inserted terminal 62. When the terminal 62 is inserted within the cavity between the first terminal position and the second terminal position, such that the terminal 62 is inserted more than the first distance and less than the second distance, the primary locking member 78 is articulated away from the first position and toward the second position as explained. When the primary locking member 78 is articulated away from the first position, the primary locking member 78 is configured to oppose and interfere with the PLR member 146 to prevent the TPA 30 from being moved to the full set position. Thus the articulated primary locking member 78 serves as a stop between the TPA 30 and the terminal 62, and the inability to move the TPA 30 to the full set position indicates an incompletely inserted terminal 62. The TPA 30 can include a plurality of the PLR members 146 to reinforce a plurality of the primary locking members 78 corresponding to a plurality of the bays 38, while detecting as few as one incompletely inserted terminal 62 among the plurality of bays 38.

With reference to FIGS. 5 and 6, the ISL member 150 can be coupled to the TPA body 142 and can be integrally formed thereon. The ISL member 150 can be located such that when the TPA 30 is inserted in the TPA slot 42, the ISL member 150 extends further in the third direction 138 than the PLR member 146. While FIGS. 5 and 6 of the example illustrate the ISL member 150 of the 2.8 bay 86 and the terminal 62 being a corresponding 2.8 terminal, it is understood throughout the discussion that the ISL member 150 can be similarly situated in any of the bays 38 to engage other types or sizes of terminals 62. The ISL member 150 can be located on the TPA body 142 such that in the preset position, the ISL member 150 does not inhibit the terminal 62 from moving in the first or second direction 114, 118 while in the full set position, the ISL member 150 is configured to oppose and interfere with a second location 158 on the terminal 62 to prevent the terminal 62 from moving in the second direction 118 and prevent the terminal 62 from being withdrawn from the cavity 54. In the example provided, the second location 158 is located at a different location along the same shoulder 122 to which the primary locking member 78 is configured to engage the terminal 62. However, the second location 158 can be a location other than the same shoulder 122 to which the primary locking member 78 engages. The ISL member 150 is configured to engage the second location 158 to secure the terminal 62 independent of the primary locking member 78. Thus, if a failure occurs in the primary locking member 78, the ISL member 150 will still secure the terminal 62 in the proper position within the cavity 54 and prevent its withdrawal.

The ISL member 150 can also serve to detect an incompletely inserted terminal 62. When the terminal 62 is inserted within the cavity 54 between the first terminal position and the second terminal position, such that the terminal 62 is inserted more than the first distance and less than the second distance, the terminal 62 will prevent the TPA 30 from being moved to the full set position by interfering with the ISL member 150. Thus the terminal 62 serves as a stop between the TPA 30 and the full set position, and the inability to move the TPA 30 to the full set position indicates an incompletely inserted terminal 62. The TPA 30 can include a plurality of the ISL members 150 to secure a plurality of the terminals 62 within a plurality of the bays 38, while detecting as few as one incompletely inserted terminal 62 within the plurality of bays 38. The detection capabilities of the ISL member 150 and the PLR member 146 are thus independent of each other and can independently verify a properly seated terminal 62.

Returning to FIG. 1, the connector assurance channel 46 can be open on the rear side 58 of the first body 22 and be configured to receive the connector assurance device 26 therein from the rear side 58. The connector assurance channel 46 can be proximal to a top or fourth side 162 of the first body 22, opposite the third side 134, and can be substantially open on the second side 70 and the fourth side 162. The connector assurance retainer 50 can extend into the connector assurance channel 46 and include a first shoulder 166. The connector assurance device 26 can include a base 170 and a first finger 174 coupled to the base 170. The first finger 174 can include a second shoulder 178 configured to oppose the first shoulder 166 to prevent the connector assurance device 26 from being removed from the connector assurance channel 46 once inserted therein to a predetermined distance.

Figure 7:
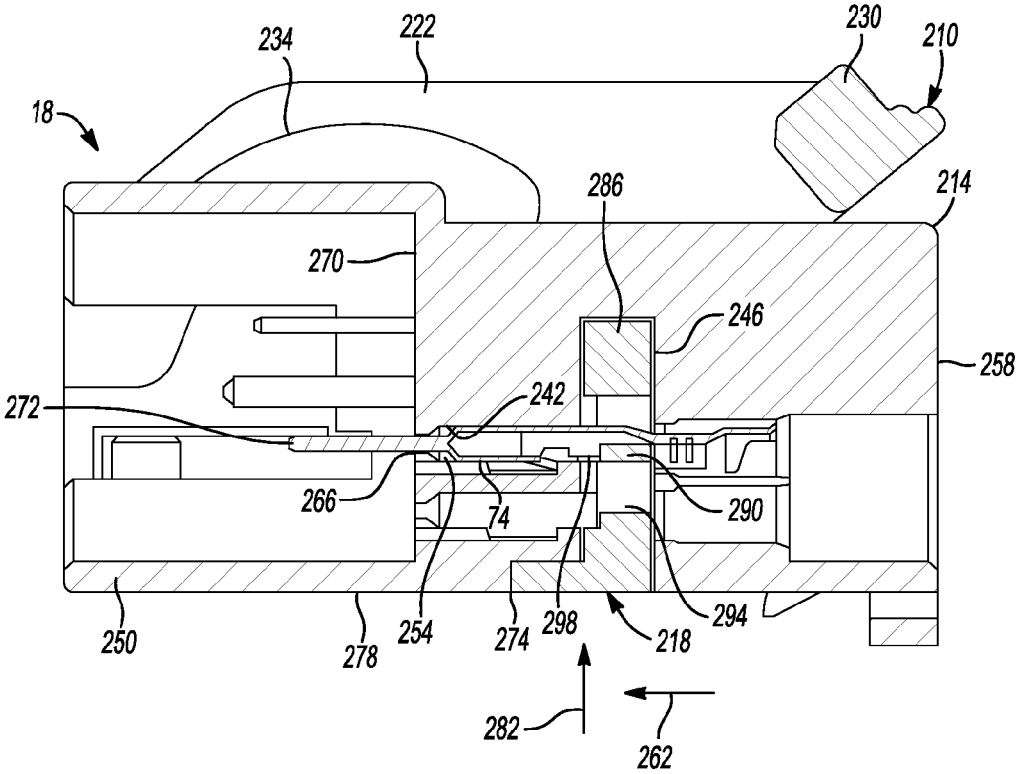
FIG. 7 is a cross section view of the second housing assembly of FIG. 2.

With reference to FIGS. 2 and 7, the second housing assembly 18 can include a lever 210, a second body 214, and a second TPA 218. The lever 210 can include a first lever body 222 and a second lever body 226, spaced apart and fixedly coupled at a first end of the lever bodies 222, 226 by a lever arm 230 extending between the first and second lever bodies 222, 226. The first and second lever bodies 222, 226 can be rotationally coupled to opposite sides of the second body 214. The first and second lever bodies 222, 226 can each define a cam groove 234 having a cam surface 238. The cam groove 234 can be open on a second end of the lever bodies 222, 226, opposite the first end, to receive the follower members 34 into the cam groove 234 when the first and second bodies 22, 214 are in a preset condition. When the follower members 34 are positioned within the cam groove 234 and the lever 210 is rotated, the cam surface 238 is configured to slideably cooperate with the follower members 34 to selectively move the first and second bodies 22, 214 between the preset condition and a fully mated condition. In the fully mated condition, all of the terminals 62 are properly mated with their corresponding mating terminals 74.

The second body 214 can define a plurality of second bays 242, a second terminal position assurance slot ("second TPA slot") 246, and a shroud 250. Each of the second bays 242 can be substantially similar to the bays 38 of the first housing assembly, and define a second cavity 254 generally open on a rear, or first side 258 of the second body 214 to receive one of the mating terminals 74 inserted in a first direction 262, from the rear side 258. As discussed above, the example connector 10 has bays 38 configured to receive 1.2 mm, 2.8 mm, and 6.3 mm terminals in a 22P×1.2+2P×2.8+2P×6.3 configuration.

Thus the second bays 242 of the exemplary second body 214 are the complementary 1.2, 2.8, and 6.3 bays. Likewise, while the second bay 242 illustrated is a 1.2 bay, it is understood that the prior and following discussion applies to other bays as well. Each of the second bays 242 can define a second mating aperture 266 on a front, or second side 270 of the second body 214 to allow the mating terminal 74 inserted within the second cavity 254 to mate with one of the terminals 62 housed in the first body 22. The second bays 242 can define a second primary locking member (not shown) substantially similar to primary locking member 78 of the first body 22, to prevent a fully inserted mating terminal 74 from being withdrawn from the second cavity 254. The mating terminals 74 can be electrically coupled to wires (not shown), which extend from the first side 258 of the second body 214 when the mating terminals 74 are inserted therein. The second bays 242 can be arranged in a one or two dimensional array complementary with the arrangement of bays 38 of the first body 22, and can likewise be of different sizes and shapes to accept different sizes or types of mating terminals 74. The mating terminals 74 can include a prong 272 configured to extend through the second mating aperture 266 and through the mating aperture 66 of the first body 22 to mate with the terminal 62 therein. In the example provided, the first housing assembly 14 is shown as the female assembly and the second housing assembly 18 is shown as the male assembly, however the first housing assembly 14 and the second housing assembly 18 can include any combination of male or female terminals 62 or mating terminals 74. It is also understood that the lever 210 can be included on the first housing assembly 14, while the second housing assembly 18 can include the follower members 34. It is further understood that the lever 210 is optional and that the connector 10 can function with neither the first housing assembly 14, nor the second housing assembly 18 including the lever 210 or follower members 34.

The second TPA slot 246 can define an aperture 270 open on a third side 278 of the second body 214, being substantially perpendicular to the front and rear sides 258, 270, and can extend into the second body 214 in a second direction 282, substantially perpendicular to the first direction 262. The second TPA slot 246 can extend into the second body 214 and penetrate into at least one of the second bays 242. The second TPA slot 246 can penetrate through some or all of the second bays 242. The second TPA slot 246 can be configured to receive the second TPA 218 inserted therein from the third side 278.

The second TPA 218 and second TPA slot 246 can be substantially similar in structure and function as the TPA slot 42 and TPA 30 of the first housing assembly 14 described above. As such, the second TPA 218 can include a second TPA body 286, a second PLR member (not shown) substantially similar to PLR member 146, and at least one second ISL member 290 coupled to the second TPA body 286 to prevent a fully inserted mating terminal 74 from being withdrawn from the second bay 242. The second TPA 218 can define second TPA aperture 294 to align with the second cavities 254 when the second TPA 218 is in a preset position. In the preset position, the mating terminals 74 can be inserted into the second cavities 254 and through the second TPA body 286 to be fully inserted within the second bays 242. In the preset position, the second ISL member 290 does not inhibit the mating terminal 74 from moving within the second cavity 254. Once the mating terminals are fully inserted, the second TPA 218 can be moved to a full set position. In the full set position, the second ISL member 290 can extend into the second cavity 254 to oppose and interfere with a shoulder 298 on the mating terminal 74 to prevent withdrawal of the mating terminal 74 from the second cavity 254.

Similarly, the second ISL member 290 can also serve to detect an incompletely inserted mating terminal 74. When the mating terminal 74 is inserted within the second cavity 254 between the first terminal position and the second terminal position, such that the mating terminal 74 is inserted more than the first distance and less than the second distance, the mating terminal 74 will prevent the second TPA 218 from being moved to the full set position by interfering with the second ISL member 290. Thus the mating terminal 74 serves as a stop between the second TPA 218 and the full set position, and the inability to move the second TPA 218 to the full set position indicates an incompletely inserted mating terminal 74. The second TPA 218 can include a plurality of the second ISL members 290 to secure a plurality of the mating terminals 74 within a plurality of the second bays 242, while detecting as few as one incompletely inserted mating terminal 74 within the plurality of second bays 242.

The shroud 250 can be configured to extend in the first direction from the perimeter of the front side 270 of the second body 214 and can extend at least beyond the prongs 272 of the mating terminals 74 to protect the prongs 272. The shroud 250 can be configured to accept a portion of the first body 22 inserted within the shroud 250 such that the shroud 250 covers, or surrounds the portion of the first body 22 when the first and second bodies 22, 214 are in the fully mated condition. The shroud can also cover the portion of the first body 22 when in the preset condition.

Returning to FIG. 1, the connector assurance device 26 is configured to be inserted into the connector assurance channel 46 when the first and second bodies 22, 214 are in the fully mated condition. When the first and second bodies 22, 214 are between the preset condition and the fully mated condition, the first and second bodies 22, 214 cooperate to prevent the connector assurance device 26 from being fully inserted within the connector assurance channel 46, to indicate that the first and second bodies 22, 214 are incompletely mated.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A connector comprising:

a first housing assembly having:

a first body defining a first locking member, a cavity, and a slot, the cavity is configured to accept a terminal inserted therein from a first side of the first body to a first distance from the first side, the slot extends into the first body from a second side and intersects the cavity, the first locking member is coupled to the first body and extends into the cavity to prevent withdrawal of the terminal when the terminal is inserted to the first distance; and an assurance body slideably inserted into the slot and movable between a preset position and a full set position within the slot, the assurance body including a reinforcing member and a second locking member;

wherein, when the assurance body is in the full set position, the reinforcing member is configured to limit movement of the first locking member to prevent the withdrawal of the terminal from the cavity, and the second locking member extends into the cavity to limit movement of the terminal and prevent withdrawal of the terminal independent of the first locking member.

2. The connector of claim 1, wherein the first locking member is movable between a first position and a second position, and the first locking member includes a locking portion extending into the cavity to secure the terminal within the cavity when in the first position, the locking portion is configured to cooperate with the terminal to move the first locking member to the second position when the terminal is inserted in the cavity less than the first distance;

wherein the reinforcing member prevents withdrawal of the terminal by preventing the first locking member from moving to the second position when the assurance body is in the full set position.

3. The connector of claim 2, wherein the first locking member is a resilient arm, the arm being coupled to the body at a first end and freely extending therefrom to a second end, the locking portion being proximal to the second end.

4. The connector of claim 2, wherein when the first locking member is in the second position, the reinforcing member engages the first locking member to prevent the assurance body from being moved to the full set position.

5. The connector of claim 2, wherein the locking portion includes a ramp surface, the ramp surface is configured to slideably engage the terminal during insertion of the terminal in the cavity to move the first locking member to the second position to allow the terminal to be fully inserted in the cavity, the first locking member is configured to return to the first position when the terminal is inserted to the first distance.

6. The connector of claim 1, wherein when the terminal is inserted in the cavity less than the first distance, the second locking member is configured to engage the terminal to prevent the assurance body from being moved to the full set position.

7. The connector of claim 1, wherein the first body defines a plurality of the cavities for receiving a plurality of terminals, and a plurality of the first locking members extending into the plurality of cavities, and the assurance body includes a plurality of reinforcing members configured to limit movement of the plurality of first locking members and a plurality of second locking members configured to prevent withdrawal of the plurality of terminals independent of the first locking members.

8. The connector of claim 1, wherein the first locking member and the second locking member are configured to prevent withdrawal of the terminal by engaging the terminal on a same shoulder of the terminal.

9. The connector of claim 1, wherein the slot penetrates the cavity from a second side of the housing, the second side being perpendicular to the first side.

10. A connector comprising:

a first housing assembly having:

a terminal;

a first body defining a resilient arm, a cavity, and a slot, the cavity is configured to accept the terminal inserted therein from a first side of the first body, and the slot intersecting the cavity from a second side of the first body substantially perpendicular to the first side, the resilient arm being moveable between a first position and a second position and being coupled to the first body at a first end and freely extending therefrom to a second end, the second end extending into the cavity when in the first position and preventing withdrawal of the terminal when the terminal is fully inserted in the cavity, and the resilient arm cooperating with the terminal to move the resilient arm to the second position when the terminal is incompletely inserted in the cavity; and an assurance body slideably inserted into the slot and movable between a preset position and a full set position, the assurance body including a reinforcing member and a locking member, the reinforcing member is configured to prevent the resilient arm from moving to the second position when the assurance body is in the full set position, the locking member is configured to extend into the cavity and prevent withdrawal of the terminal independent of the resilient arm when the terminal is fully inserted in the cavity and the assurance body is in the full set position;

wherein the terminal prevents the assurance body from being moved to the full set position when the terminal is incompletely inserted in the cavity.

11. The connector of claim 10, wherein the first body defines a plurality of cavities configured to receive a plurality of terminals, and includes a plurality of resilient arms configured to extend into the cavities to prevent withdrawal of the plurality of terminals, and the assurance body includes a plurality of reinforcing members configured to prevent movement of the plurality of resilient arms and a plurality of locking members configured to prevent withdrawal of the plurality of terminals independent of the plurality of resilient arms.

12. The connector of claim 10, wherein the resilient arm and the locking member are configured to engage the terminal at a same shoulder on the terminal to prevent withdrawal of the terminal.

13. The connector of claim 10, wherein when the resilient arm is in the second position, the reinforcing member is configured to engage the resilient arm to prevent the assurance body from being moved to the full set position.

14. The connector of claim 10, wherein when the terminal is incompletely inserted in the cavity, the locking member is configured to engage the terminal to prevent the assurance body from being moved to the full set position.

15. The connector of claim 10, wherein the resilient arm includes a ramp surface, the ramp surface is configured to slideably engage the terminal during insertion of the terminal in the cavity to move the resilient arm to the second position to allow the terminal to be fully inserted in the cavity, the resilient arm is configured to return to the first position when the terminal is fully inserted therein.

16. The connector of claim 10, further comprising a second housing assembly configured to mate with the first housing assembly, wherein the second housing assembly includes a second body, and one of the first housing assembly and the second housing assembly includes a lever, pivotably coupled to one of the first and second bodies, the lever defining a cam surface, the other of the first and second housing assemblies including a follower member, the cam surface and the follower member are configured to cooperate to selectively move the first and second housing assemblies between a preset condition and a fully mated condition when the lever is articulated.

17. A connector comprising:

a first housing assembly having:

a terminal;

a first body defining a cavity and a slot, the cavity configured to accept the terminal inserted therein in a first direction, the slot substantially perpendicular to the cavity and intersecting the cavity; and a resilient arm coupled to the first body at a first end and freely extending therefrom in the first direction to a second end, the resilient arm is moveable between first and second positions and includes a locking surface and a ramp surface extending into the cavity when in the first position, the locking surface is configured to prevent withdrawal of the terminal when the terminal is fully inserted in the cavity and the resilient arm is in the first position, the ramp surface is configured to slideably engage the terminal during insertion to move the resilient arm to the second position, the resilient arm is biased to return to the first position when the terminal is fully inserted therein; and an assurance body slideably inserted into the slot and movable into between a preset position and a full set position, the assurance body including:

a reinforcing member configured to prevent the resilient arm from moving to the second position when the assurance body is in the full set position; and a locking member configured to extend into the cavity to prevent withdrawal of the terminal independent of the resilient arm when the terminal is fully inserted and the assurance body is in the full set position;

wherein the reinforcing member is configured to prevent the assurance body from being moved into the full set position when the resilient arm is in the second position, and the locking member is configured to engage the terminal to prevent the assurance body from being moved into the full set position and indicate an incompletely inserted terminal when the terminal is incompletely inserted in the cavity.

18. The connector of claim 17, wherein the first body defines a plurality of cavities configured to receive a plurality of terminals, the housing includes a plurality of resilient arms configured to secure the plurality of terminals, and the assurance body includes a plurality of reinforcing members configured to limit movement of the plurality of resilient arms and a plurality of locking members configured to prevent withdrawal of the plurality of terminals independent of the plurality of resilient arms.

19. The connector of claim 17, wherein the resilient arm and the locking member are configured to engage the terminal at a location positioned a same longitudinal distance along the terminal to prevent withdrawal of the terminal.

20. The connector of claim 17, further comprising a second housing assembly configured to mate with the first housing assembly, wherein the second housing assembly includes a second body, and one of the first housing assembly and the second housing assembly includes a lever, pivotably coupled to one of the first and second bodies, the lever defining a cam surface, the other of the first and second housing assemblies including a follower member, the cam surface and the follower member are configured to cooperate to selectively move the first and second housing assemblies between a preset condition and a fully mated condition when the lever is articulated.

* * * * *